United States Patent [19]

McPhail

[11] 4,297,812

[45] Nov. 3, 1981

[54] STORM DOOR ASSEMBLY

[76] Inventor: Shelvey C. McPhail, 4924 NW. 31st St., Oklahoma City, Okla. 73122

[21] Appl. No.: 60,787

[22] Filed: Jul. 25, 1979

[51] Int. Cl.[3] ..... E05F 1/10

[52] U.S. Cl. ..... 49/386; 16/78; 49/380; 49/400

[58] Field of Search ..... 49/380, 386, 399, 400, 49/401; 16/71, 78

[56] References Cited

U.S. PATENT DOCUMENTS

| | | | |
|---|---|---|---|
| 1,343,033 | 6/1920 | Campbell | 16/78 |
| 2,725,960 | 12/1955 | Milone | 49/400 X |
| 3,002,592 | 10/1961 | Quinn | 49/399 |
| 3,160,244 | 12/1964 | Rushner et al. | 49/400 X |
| 3,566,539 | 3/1971 | Ridgley | 49/380 |
| 4,106,238 | 8/1978 | Bonello | 49/399 X |

FOREIGN PATENT DOCUMENTS

| | | | |
|---|---|---|---|
| 1044911 | 10/1966 | United Kingdom | 16/78 |

*Primary Examiner*—Kenneth Downey
*Attorney, Agent, or Firm*—William R. Laney

[57] ABSTRACT

A storm door assembly which includes a U-shaped Z-bar, a reinforcing element insertable between one leg of the Z-bar and the door jamb, and a door hingedly connected to the Z-bar. The door includes a top rail, bottom rail, side rails and a center mullion. A return spring assembly is enclosed and hidden within one or more of the top or bottom rails or the center mullion, each of which is hollow. A sliding latching assembly is provided on one of the side rails of the door, and is slidingly movable to a position of cooperation with a portion of the return spring assembly to prevent the door from moving from an open position toward a closed position until the latching assembly has been intentionally released.

12 Claims, 8 Drawing Figures

STORM DOOR ASSEMBLY

BACKGROUND OF THE INVENTION

1. Field of the Invention

This invention relates to storm door and window assemblies, and more particularly, to a storm door assembly of the type having a Z-bar which frames a pivotally mounted storm door within the opening through an existing framed doorway.

2. Brief Description of the Prior Art

The installation and utilization of storm doors and windows has proliferated over the past several years, and the use of these devices for providing reduced transmission of heat energy through the door and window openings of houses has accelerated rapidly during the more recent period of energy conservation awareness. Many types of storm doors have been designed and used with varying degrees of effectiveness in terms of their functioning as a thermal barrier, and with various aesthetic effects. One type of assembly which has been widely used includes a so-called Z-bar, which is U-shaped in overall configuration to fit around, and partially within, the door opening formed in a house, and an extruded metal storm door which is pivotally supported on the Z-bar. Such storm doors usually are provided with a solid sheet metal kick plate in the lower portion thereof, a central cross mullion, a top and a bottom rail and a pair of side rails. The upper portion of the door may include one or more glass paned sashes, and channels, or tracks, provided to carry a movable screen.

Examples of doors of this type which have previously been patented include those shown in U.S. Pat. No. 3,024,501 and U.S. Pat. No. 3,177,924 issued to Shelvey C. McPhail, and U.S. Pat. No. 2,836,269 issued to Anderson.

Frequently storm doors are utilized in climates where stormy conditions occur from time to time, and high winds are not infrequent. It is important that storm doors subjected to such conditions be sturdily mounted and strongly secured to the Z-bar and to the door jamb adjacent the Z-bar in order to prevent their being sprung or pulled entirely loose from their mounting as a result of slamming or swinging open quite forcefully during windy conditions.

It will also generally be desirable to provide a storm door construction with some type of spring return system which causes the door to return to its closed position after it has been opened. In conjunction with such spring return systems, some form of latching structure is needed which coacts with the return system to allow the door to be temporarily locked or latched in an open or partially open position. This is particularly desirable when it is desired to have the door stand open to allow furniture or other articles to be moved through the door opening without having to manually open and close the door each time the opening is traversed.

Many of the types of spring return systems or assemblies which have previously been provided are exposed to view, and are connected at one end between either the Z-bar or the door jamb, and at the other end to a portion of the storm door pivotally supported in the Z-bar. Where such exposure to view is characteristic of the return spring assembly, the aesthetic overall appearance of the storm door assembly is usually adversely affected. Moreover, such exposure subjects the return spring assembly to the debilitating influence of inclement weather, and in some mounting arrangements even constitutes a safety hazard to small children.

BRIEF DESCRIPTION OF THE PRESENT INVENTION

The present invention provides a storm door assembly of the Z-bar type which is improved in several respects to make the assembly more functional, and at the same time more aesthetically pleasing. The door is sturdily constructed and very easily mounted in an existing door opening where, when installed, the door functions smoothly and easily without malfunction over an extended period of time.

Broadly described, the storm door assembly of the invention includes a Z-bar which is U-shaped in its overall configuration for conformity to the opposed sides and top of an existing door opening, an elongated reinforcing element of generally right-angle configuration adapted for insertion between one leg of the Z-bar and a door jamb in which the storm door assembly is mounted, and a generally rectangular storm door hingedly connected along one of its side edges to the Z-bar. The storm door includes top and bottom rails, side rails and a center mullion. A return spring assembly is enclosed and hidden within one or more of the top rail, bottom rail or center mullion, each of which is hollow.

In a preferred embodiment of the invention, a sliding latching assembly is provided on one of the side rails of the door, and is slidingly movable to a position of cooperation with a portion of the return spring assembly to prevent the door from moving from an open position toward a closed position until a time when the latching assembly has been intentionally released. The storm door assembly also preferably includes an aesthetic hinging arrangement by which the door is hinged to the Z-bar in a manner which provides an aesthetic exposure of minimal portions of the hinge structure, yet provides a very strong hinged connection having an extended and effective service life.

From the foregoing description of the invention, it will be perceived that the storm door assembly of the invention is a structure which is sturdily constructed and arranged, and is characterized in having a long and trouble-free operating life.

Another objective achieved by the invention is the provision of a storm door assembly in which a return spring subassembly is mounted in a protected and hidden location so that the door is aesthetically improved, the spring subassembly is protected from the elements and the door is safer to utilize.

Another object of the invention is to provide a storm door assembly which includes a latching mechanism which enables the door to be quickly latched in an open position or released therefrom, at the option of the user.

A further object of the invention is to provide a storm door assembly in which a generally rectangular storm door is mounted within a U-shaped Z-bar by a novel hinge construction which provides a strong connection which is aesthetically pleasing in the context of the overall storm door assembly.

A further object of the invention is to provide a storm door assembly which provides a very strong mechanical mounting of the door to a supporting Z-bar and door jamb so that the door is not easily disconnected or torn from its points of anchorage to the Z-bar and door jamb under high wind conditions.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
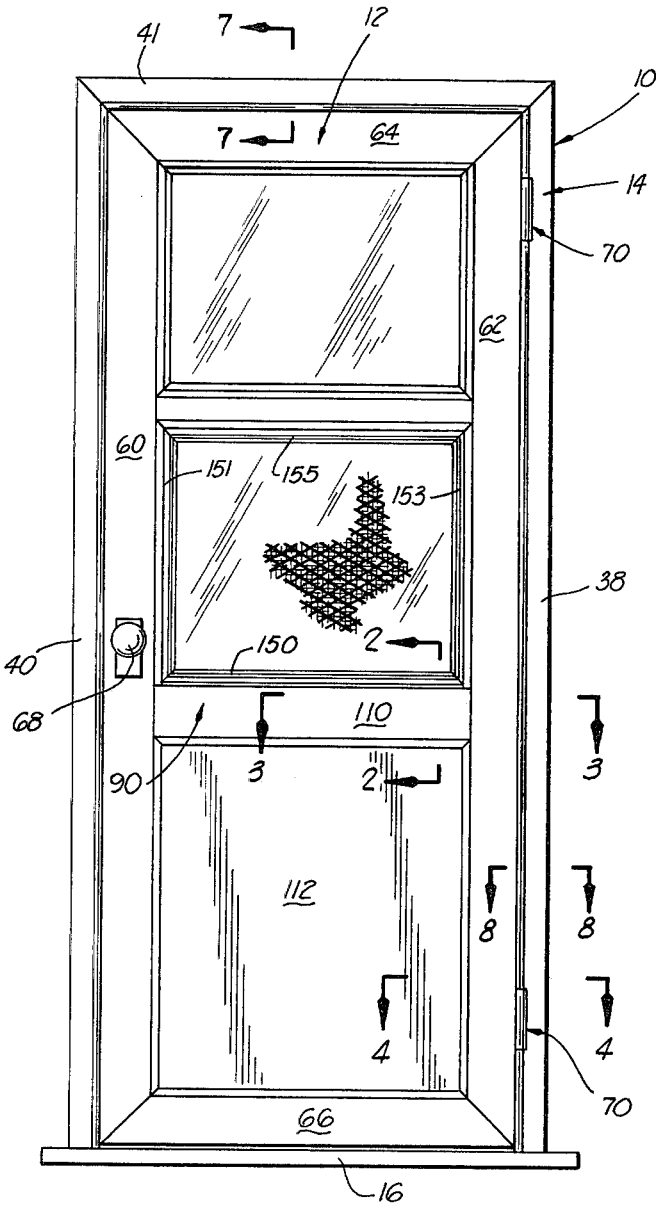
FIG. 1 is a front elevation view of the storm door assembly of the invention as it appears when viewed from outside a home in which the assembly is mounted.

Referring initially to FIG. 1 of the drawings, the storm door assembly of the invention is illustrated herein as it appears when mounted in a framed door opening. The storm door assembly includes a generally U-shaped Z-bar 10 and a storm door 12 which is hingedly mounted in the Z-bar 10 by means of a hinge subassembly 14. An elongated reinforcing flange 15 extends between a side portion of the Z-bar 10 and a part of the door jamb. A conventional threshold 16, which does not constitute a part of the present invention, is positioned at the bottom of the door opening.

Figure 8:
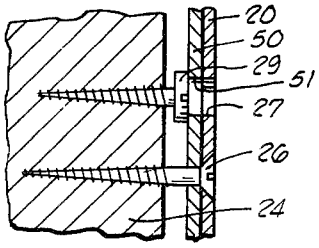
FIG. 8 is a detail view, in section, taken along line 8—8 of FIG. 1.
Figure 7:
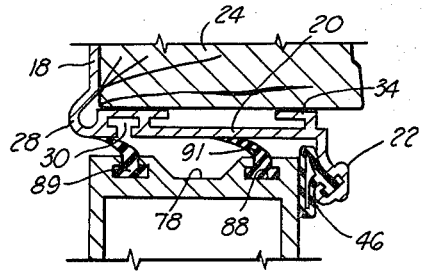
FIG. 7 is a detail view, in section, taken along line 7—7 of FIG. 1.
Figure 3:
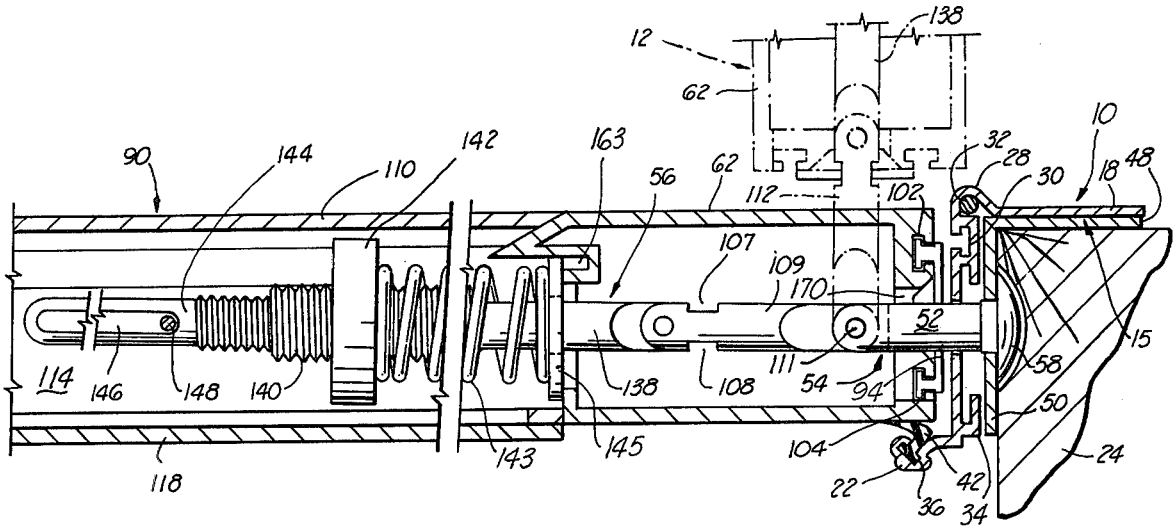
FIG. 3 is a sectional view taken along line 3—3 of FIG. 1.
Figure 4:
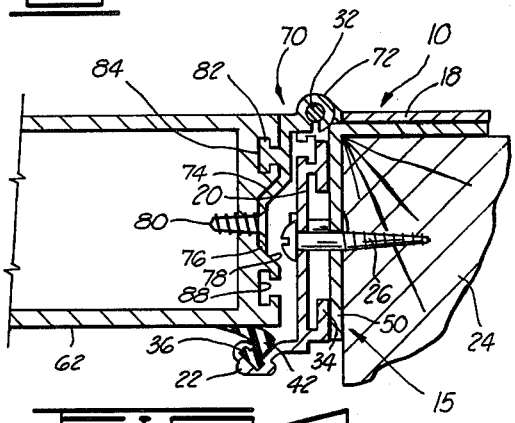
FIG. 4 is a sectional view taken along line 4—4 of FIG. 1.

The Z-bar 10 is shown in section in FIGS. 3, 4 and 7. It includes an outer or facing flange 18 which is positioned adjacent the outer side of a door jamb 24, a central web portion 20 which extends substantially normal to the facing flange 18 and an inner rear bead 22 which extends generally normal to the central web portion 20. The Z-bar 10 is preferably extruded metal, with the facing flange, web portion and rear bead integrally formed. The Z-bar 10 is secured to the inner face of the door jamb 24 which frames the door opening by means of a plurality of screws 26 extended through the web portion 20, through the reinforcing flange 15 and into the door jamb. The central web portion 20 is further provided with a plurality of adjusting screw access apertures 27, one of which is shown in FIG. 8 and which facilitate access to adjusting screws 29 for a purpose hereinafter described.

The Z-bar is geometrically configured to provide a number of slots and channels which are utilized in the assembly of the storm door system. Thus, adjacent the outer or facing flange 18, the Z-bar is turned through a curvilinear section 28 which defines, with an inset T-shaped channel 30, a guideway for the reception of an elongated hinge pintle 32. At the opposite side of the web portion 20 from that at which the inset T channel 30 is located, an underturned portion 34 of the Z-bar is joined to the web portion and functions to space the web portion from the reinforcing flange 15, and is located in parallel relation thereto.

The inner rear bead 22 of the Z-bar is shaped to form a second T channel 36 which opens in a direction facing generally toward the web portion 20 as best illustrated in FIGS. 3 and 4. The T-shaped channel 36 extends completely around the Z-bar, which includes a pair of opposed parallel sides 38 and 40 and a transverse header 41. At that side 38 of the Z-bar which is hinged to the door 12, the channel 36 carries a reverse bent elastomeric sealing strip 42. On the header 41 and opposite side 40 of the Z-bar, however, the channel 36 carries a hollow tubular elastomeric bead 46 which is resiliently distorted into a flattened status as shown in FIG. 7 at a time when the door 12 is closed.

The elongated L-shaped reinforcement flange 15 is provided for a purpose to be hereinafter explained, and includes a facing plate 48 which underlies the facing flange 18 of the Z-bar 10 and flatly abuts the outer face of the door jamb 24. The reinforcing flange 15 further includes an internal plate 50 which abuts the door jamb 24 and is positioned between the web portion 20 of the Z-bar and the door jamb. The internal plate 50 is provided with adjusting screen access apertures 51 which are aligned with the adjusting screw apertures 27 in the central web portion of the Z-bar. The reinforcing flange 15 is secured to the door jamb 24 by means of the screws 26 previously described, and concurrently used to hold the Z-bar to the door jamb. It will thus be noted that there are no screws exposed at the outer side of the storm door assembly, thus improving the aesthetics of the assembly, but more importantly, affording, by this construction, an important safeguard against burglary.

As shown in FIG. 3, the internal plate 50 of the reinforcing flange 15 is apertured at a location intermediate its length (from the top of the door to the bottom) to facilitate extension through the aperture of the shank 52 of an articulated bolt designated generally by reference numeral 54. The articulated bolt 54 forms a part of the spring return subassembly designated generally by reference numeral 56 and hereinafter described in detail. The head 58 of the articulated bolt 54 is recessed into the door jamb 24 as illustrated in FIG. 3 and bears against the inner plate 50 of the reinforcing flange 15.

The storm door 12 includes a pair of opposed, substantially parallel hollow side rails 60 and 62 which are substantially identically constructed, a hollow header or top rail 64 and a hollow bottom rail 66 which interconnects the side rails 60 and 62 in a substantially rectangular configuration. A conventional doorknob and latch subassembly 68 is provided in the side rail 60 and functions in the usual manner to latch the door in a closed position. The side rail 62 constitutes the hinged side of the storm door 12, and is connected to the Z-bar 10 in a manner hereinafter described.

For the purpose of hingedly mounting the storm door 12 within the Z-bar 10, a plurality of hinge elements designated generally by reference numeral 70 are provided in vertically spaced relation along the side rail 62 of the door. In FIG. 1, two of these hinge elements 70 are illustrated as being used in the illustrated embodiment of the assembly. Each of the hinge elements 70 includes a tubular end portion 72 which is configured to register with the curvilinear section 28 forming a part of the Z-bar. With the tubular end portion 72 in registration with the curvilinear section 28 of the Z-bar 10, the elongated hinge pintle 32 is inserted through both the curvilinear section 28 and the tubular end portion 72 of the several hinge elements 70 to mount the hinge elements on the Z-bar for pivotation about the axis of the hinge pintle. A pair of small washers 73 are provided at the opposite sides of each tubular end portion 72 between the respective end portion and the adjacent parts of the curvilinear section 28 of the Z-bar 10. It should be pointed out that this construction enables a single elongated hinge pintle 32 to be employed so as to interconnect the several hinge elements 70 to the Z-bar by means of a single pin, or several of the hinge pintles of shorter length can be used in association with each of the hinge elements 70 at the location where it is to engage the curvilinear section 28 of the Z-bar.

Figure 5:
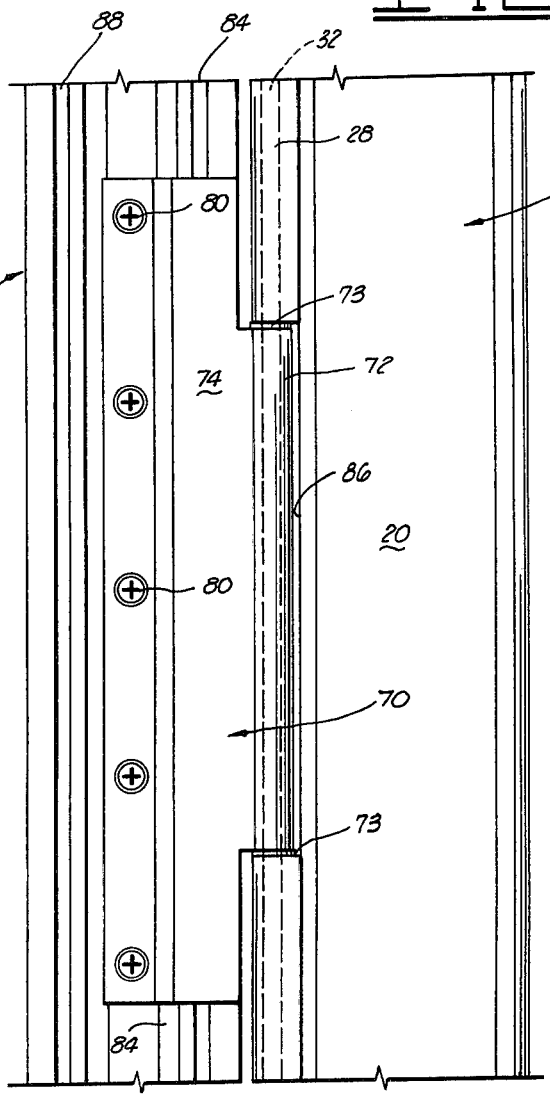
FIG. 5 is a detail view showing a part of the hinge structure utilized in the storm door assembly.

Each hinge element 70, which preferably is an extruded metal member, includes a mounting section 74 which projects inwardly from the tubular end portion 72, and is configured to mate with the geometric configuration of the facing portion of the side rail 62 of the door 12 which faces the door jamb 24. Thus, an inner securement flange 76 is provided for extending into and mating with the bottom of a channel 78 formed in the facing portion of the side rail 62, as shown in FIG. 5, and the inner securement flange is provided with a plurality of spaced apertures therethrough to enable a plurality of securing screws 80, or rivets or other fastening members, to be screwed through the bottom of the channel 78 formed in the facing portion of the side rail 62. It will further be noted that each of the hinge elements 70 carries a T-shaped tongue 82 which mates with a recess 84 of complementary configuration formed adjacent the channel 78 in the facing portion of the side rail 62. A T-shaped recess 88 which is configured identically to the recess 84 is disposed on the opposite side of the channel 78 in the side rail 62. This same dual channeled construction is characteristic of the side rail 60 and the header or top rail 64. In the case of these rails, the T-shaped recesses 84 and 88 are used to receive resilient sealing elements 89 and 91 as shown in FIG. 7.

The construction and arrangement of the hinge elements 70 is such that the hinge elements are secured to the door 12 by initially inserting the T-shaped tongue 82 of each hinge element into the T-shaped recess 84 where this recess opens at the bottom or top of the facing portion of the side rail 62, and then sliding the hinge element downwardly until it is at the correct position for the tubular end portion 72 thereof to register with a slot or gap 86 formed in the curvilinear section 28 of the Z-bar. At the time of such registration, the washers 73 are positioned. A number of the slots or gaps 86 which corresponds to the number of hinge elements 70 to be used is formed in the Z-bar, and the relationship of one such slot to one of the hinge elements 70 when the door is hingedly mounted in the Z-bar is illustrated in FIG. 5. In referring to this figure of the drawings, it will be noted that the tubular end portion 72 of the hinge element 70 there illustrated is not so long as the mounting section 74 of the hinge element. By making the mounting section 74 extend along a substantial portion of the length of the side rail 62, greater strength is imparted to the hinge connection, and the hinge is less susceptible to failure.

At a location which is slightly below a center mullion 90 of the storm door 12 along the vertical length of the side rail 62, a keeper or latch subassembly 92 is mounted on the jamb-facing portion of the side rail 62. The latch subassembly 92 includes a sliding, bifurcated locking element 94 which has a slot or bifurcation 96 formed in the upper end thereof and an oval, elongated slot 98 formed in the central portion thereof in alignment with the bifurcation. A stop and guide element 100, which includes an enlarged head 101 having a screw shank attached thereto, is threaded into the bottom of the channel 78 in the jamb-facing portion of the side rail 62 so that the shank of the screw passes through the oval slot 98, and the large head of the stop element 100 is positioned on the outer side of the sliding bifurcated locking element 94. The stop and guide element 101 further includes a guide rib 103 fitted into the channel 78 and protruding into the slot 98 in order to guide the locking element 94 during its reciprocating movement. Upward and downward movement of the locking element 94 is limited, however, by the stop element which is, of course, stationarily secured to the facing portion of the side rail 62.

Figure 6:
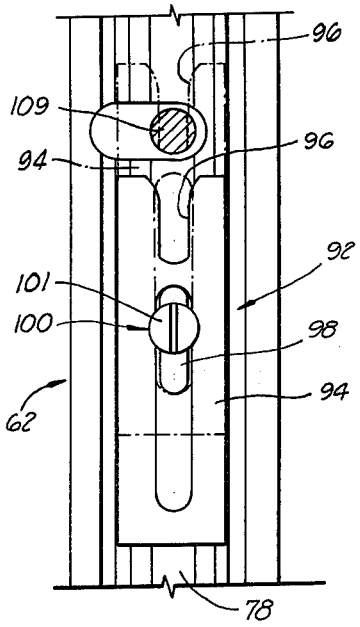
FIG. 6 is a detail view, partially in elevation and partially in section, showing a latching subassembly utilized in the storm door assembly of the invention.

In assembling the door 12, the keeper or latch subassembly 92 is placed in position prior to the time that the hinge elements 70 are slid into their proper positions opposite the slots 86 formed in the Z-bar 10 for the reception of the tubular end portions 72 of the respective hinge elements. The position of the latch subassembly 92 is such that the sliding, bifurcated locking element 94 can be moved from the solid line position shown in FIG. 6 to the position in which it is there illustrated in dashed lines. In the latter position it is oriented to engage a pair of flats or slots 107 and 108 formed in opposite sides of an intermediate rod portion 109 constituting a second part of the articulated bolt 54. The purpose of this engagement will be hereinafter explained in greater detail. The intermediate rod portion 109 is pivotally connected to the bolt shank 52 by means of a shearable pivot pin 111.

As previously indicated, the articulated bolt 54 forms a portion of a spring return subassembly 56. The spring return subassembly 56 is best illustrated in FIG. 3. This subassembly is predominantly mounted within the hollow interior of a hollow center mullion 90 which extends between the side rails 60 and 62 of the door 12, and parallel to the top rail 64 and bottom rail 66. The center mullion 90, which is preferably an extrusion of aluminum or other metal, has a front plate 110 which overlaps a solid kick plate 112 at its lower edge. The kick plate 112 forms the lowermost panel in the storm door 12 and extends between the center mullion 90, the bottom rail 66 and the side rails 60 and 62. The center mullion 90 further includes a bottom plate 114, a top plate 116 and a removable inside inspection plate 118. The inspection plate 118 has a pair of spring elements 120 and 122 secured to one side thereof to permit the inspection plate to be snapped into a closing position by engagement of the spring elements 120 and 122 with in-turned edges 124 and 126 carried on the bottom plate 114 and top plate 116 of the center mullion 90, respectively. The inspection plate 118 is removable to permit access to be had to the spring return subassembly 56 for adjustment, repair or replacement of this assembly.

Figure 2:
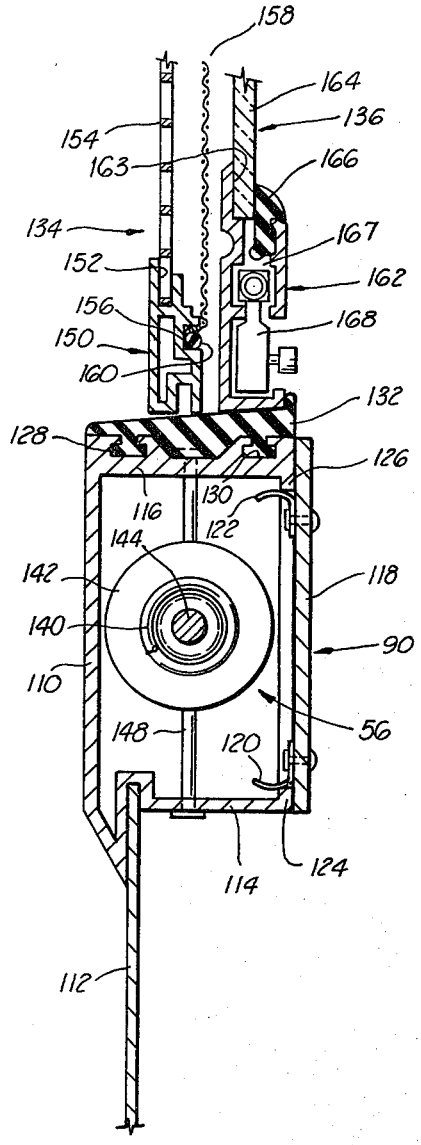
FIG. 2 is a sectional view taken along line 2—2 of FIG. 1.

The top plate 116 of the center mullion 90 is extruded to form therein a pair of spaced T-shaped recesses 128 and 130 as shown in FIG. 2. The recesses 128 and 130 serve to anchor a transverse resilient sealing pad 132 which covers the top plate of the center mullion, and provides a cushion support and seal upon which rest a novel screen subassembly, designated generally by reference numeral 134, and a window sash subassembly 136, both of which will be hereinafter described in greater detail.

In addition to the articulated bolt 54, the spring return subassembly 56 further includes an elongated spring rod 138 which is externally threaded adjacent one of its ends as shown at 140. The external thread 140 serves to threadedly engage internal threads carried in a central opening through a spring stop disc 142 which is thus mounted for adjusting movement along the length of the elongated spring rod. A helical compression spring 143 surrounds a portion of the elongated spring rod 138, and bears at one of its ends against the stop disc 142 and at its other end against a washer 145 which abuts the inner side of the side rail 62. The outer part of the elongated spring rod 138 is provided with an axially extending, internally threaded bore which receives the externally threaded end portion of a spring rod extension 144. The opposite end of the spring rod extension 144 defines an elongated, axially extending slot 146. The axially extending slot 146 receives a keeper pin 148 which is extended between the top plate 116 and bottom plate 114 of the center mullion 90.

The construction of the screen subassembly 134 can best be perceived by reference to FIGS. 1 and 2. The screen subassembly includes an elongated bottom rail 150 of the cross-sectional configuration shown in FIG. 2, two side rails 151 and 153 and a top rail 155 which conform substantially in configuration to the bottom rail. The bottom rail 150 includes a channel 152 which opens upwardly toward the center of the screen subassembly, and functions to receive an expanded metal grid 154 which projects in a vertical plane and has side and top edges which extend into, and are received by, inwardly facing channels in the side rails 151 and 153 and top rail 155 corresponding to the channel 152 in the bottom rail 150. The bottom rail 150 further includes a channel 156 which opens toward the inner side of the storm door. The channel 156 functions to receive one edge of a screen panel 158 which is wedged in position in the channel 154 by means of an elastomeric keeper bead 160. The rails 151, 153 and 155 are preferably each integrally formed, extruded metal elements.

The slidable window sash subassembly 136 includes an extruded lower rail 162 which receives, in an upwardly opening relief 163, a glass pane 164 glazed by an elastomeric glazing strip 166 which is received in an upwardly opening channel 167 of the rail 162. A pair of retractable spring latch devices 168 are provided at opposite ends of the lower rail 162, and each includes a projecting portion (not visible) which is spring biased to a position in which it extends from the respective end of the lower rail 162 into receiving channels 163 formed in the side rails 60 and 62 of the storm door. The spring biased retractable latch device 168, in conjunction with projecting retainer studs carried at the opposite sides of the upper end portion of the slidable window sash subassembly, permit this subassembly to be slid vertically in tracks or channels formed in the side rails 60 and 62 of the storm door to allow ventilation through the storm door.

USE AND OPERATION

As the storm door is manufactured, the parallel sides 38 and 40 of the Z-bar 10 will generally be made of sufficient length that any door opening can be accommodated by the U-shaped Z-bar. Thus, the storm door assembly of the invention is made substantially universal in its adaptability to installation in varying sizes of door openings.

The storm door assembly will normally be shipped to the purchaser for installation with the storm door 12 hingedly mounted within the Z-bar 10. Assuming, however, that the Z-bar and storm door are separately shipped and need to be assembled prior to placement of the storm door assembly in the door opening, the hinge elements 70 are mounted on the storm door in the manner previously explained, so that the tubular end portions thereof will register with the curvilinear section 28 of the Z-bar, with the circular openings therethrough aligned with the opening within the curvilinear section of the Z-bar for receiving the hinge pintle. This arrangement will, of course, be such that the pintle 32 can be easily driven into position from the open lower end of the channel or recess defined by the curvilinear section 28 of the Z-bar. As previously indicated, either individual pintle pins can be used in correspondence to the number of hinge elements employed, or a single long pintle pin may be driven through the entire length of the curvilinear section of the Z-bar to effect engagement of all of the hinge elements 70 with the curvilinear section 28 of the Z-bar. Prior to placement of the pintle pin in its position of inter-engagement with the curvilinear section of the Z-bar and with the hinge elements 70, a pair of small washers 73 are placed on opposite sides of the tubular end portion 72 of each of the hinges, between this section of each hinge and the adjacent parts of the curvilinear portion of the Z-bar.

After the door has been hingedly connected to the Z-bar in the manner described, the Z-bar is placed within the door opening, and the door is opened out so that it extends at 90° to the plane of the opening. At this time, that is, when the Z-bar and the storm door hinged thereto have been placed within the door opening so that the facing flange 18 of the Z-bar abuts the outer face of the door jamb 24, a pencil point is extended through the aligned adjusting screw access apertures 27 in the central web portion 20 of the Z-bar to make small marks on the inner side of the door jamb. Normally, the Z-bar 10 and reinforcing flange 15 will include at least two pairs of aligned adjusting screw access apertures 27, these being located approximately one foot upwardly from the lower end of each leg or side of the Z-bar 10.

After thus scribing marks on the inner face of the door jamb and in horizontal alignment with the adjusting screw access apertures 27, the Z-bar 10 and storm door 12 are removed from the door opening, and the adjusting screws 29 are screwed into the door jamb 24 at the location of the marks and so that the head of the adjusting screws will be located in alignment with the adjusting screw access apertures 27 as shown in FIG. 8. Preferably, the adjusting screws are screwed into the door jamb to a depth such that the head of the adjusting screw is spaced from about 1/16" to ¼" from the face of the door jamb.

After placement of the adjusting screws 27 in the manner described, the Z-bar 10, the L-shaped reinforcing flange 15 and the storm door 12 are reinserted in the door opening so that the elongated L-shaped reinforcing flange 15 abuts the door jamb 24, with the facing plate 48 on the outer side of the door jamb, and the internal plate 50 extending parallel to the inner face of the door jamb. The insertion is such that the facing flange 18 and central web portion 20 of the Z-bar 10 extend parallel to the facing flange 18 and internal plate 50, respectively, of the reinforcing flange 15. The reinforcing flange 15 is coextensive in length with one leg of the Z-bar, so that no difficulty is provided in properly aligning these within the door openings.

After replacement of the Z-bar 10 and storm door 12 within the door opening is accomplished, the door is opened out from the Z-bar, as shown in FIG. 3 in dashed lines, and the securement screws 26 are extended through their respective openings in the web portion 20 of the Z-bar and the internal plate 50 of the reinforcement flange 15 and on into the door jamb, so that the assembly is secured to the door jamb. Before tightening the securing screws 26, however, the adjusting screws 29 are screwed inwardly or outwardly with respect to the reinforcing flange 15 and Z-bar 10 to cause the Z-bar to be canted and adjusted in its spacing from the inner face of the door jamb, and thus properly fit and position the assembly within the door opening. Stated differently, the adjusting screws 29 function as adjustable shim elements to shim the Z-bar outwardly with respect to the inner face of the door jamb as needed to make the Z-bar, and the reinforcing flange along one side of it, fit snugly within the door opening.

After such adjustments of fit have been made by the use of the adjusting screws 29, the securing screws 26 are screwed down tightly to firmly secure the Z-bar around its periphery to the door jamb.

For greatest ease of installation, it may be desirable initially to inactivate the spring return assembly by disconnecting rod portion 109 from the shank 52 of the articulated bolt by removal of the shearable pivot pin 111. Then, after the storm door 12 and Z-bar 10 have been mounted in the door opening with the Z-bar lying over the reinforcing flange 15 in the manner illustrated in FIGS. 3 and 4, the removable inside inspection plate 118 is snapped out of its closed position (shown in FIG. 2) to open the interior of the center mullion 90. At this time, it is relatively easy to push against the spring stop disc 142 to compress the helical spring 143, and in doing so to push the elongated spring rod 138 to the left, along with the intermediate rod portion 112. It will be seen that when the door 12 is pivoted outwardly to the dashed line position illustrated in FIG. 3 on the hinge elements 70, this movement toward the outer side of the door of the elongated spring rod 138 and the intermediate rod portion 109 will permit the intermediate rod portion 109 to be pivotally pinned to the shank 52 of the articulated bolt 54 which has been caused to pass free of the side rail 62 of the door 12 by the outward pivotal movement of the door. The movements of the intermediate rod portion 109 and the bolt shank 54 into and out of the hollow interior of the hollow side rail 62 of the door 12 is accommodated by a large opening 170 formed in the side of the rail which faces the Z-bar and door jamb.

When the described pivotal interconnection of the intermediate rod portion 109 to the shank 52 of the articulated bolt 54 has been effected, the spring return subassembly 56 becomes operative. It will be recalled that at this time (the instant of connection of the rod portion 109 to the shank 52 of the articulated bolt 54), the spring 143 has been compressed by pushing toward the left (as the subassembly is viewed in FIG. 3) upon the spring stop disc 142. Movement in this direction can be accommodated by reason of the location of the keeper pin 148 within the axially extending slot 146. With the spring so compressed, it resiliently urges or biases the spring rod extension 144 toward the opposite side of the door, or toward the left as the subassembly is viewed in FIG. 3. This movement in turn tends to force the intermediate rod portion 109 and elongated spring rod 138 into the hollow interior of the center mullion 90, and in order to allow this to occur, the door must pivot back toward its closed position. Thus, the spring return subassembly 56 functions to resiliently bias the door 12 to the closed position shown in full lines in FIG. 3.

For purposes of adjusting the force with which the storm door 12 will be swung to its closed position by the resilient bias of the spring return subassembly 56, two adjustments can be made. First, the spring stop disc 142 can be screwed toward the left on the external threads 140 carried by the elongated spring rod 138. Movement of the spring stop disc 142 outwardly on the spring rod 138 will result in the compression spring 143 undergoing a smaller magnitude of compression when the door is opened, and thus its return or door closing force will be smaller. It is also possible to obtain some adjustment in the restorative force exerted by the spring return subassembly 56 by screwing the spring rod extension 144 into or out of the threaded bore formed in the outer end of the elongated spring rod 138. When the keeper pin 148 has reached the limit of its travel by reason of abutment against the axially extending slot 146, the spring no longer effectively functions to bias the door to a closed position. Thus, the resilient force acting to close the door ends at this time, which may be desirable after the initial impetus towards closing is created by the spring, under compression, pushing the elongated spring rod 138 and the spring rod extension 144 to the left as previously described.

It will be perceived that the spring return subassembly 56 is substantially entirely concealed within the hollow interior of the center mullion 90. It is readily accessible, however, for repair or adjustment of spring compression by the simple procedure of quickly removing the removable inside inspection plate 118.

When the storm door 12 is swung to its closed position, banging of the door is prevented by the provision of the tubular elastomeric beads 46 which extend across the header 41 of the Z-bar and downwardly along the vertically extending side 40 thereof. Moreover, the tubular elastomeric beads 46, along with the reverse bent sealing strips 42 carried on the hinge side of the Z-bar, assure a weathertight seal completely around the storm door 12 when it is closed.

On some occasions, such as when one is moving into or out of a house, it is desirable to have the storm door 12 remain in an open position and to neutralize the closing action of the spring return subassembly 56. The keeper or latch subassembly 92 is provided for this purpose. When the latch subassembly 92 is to be utilized, the door is first opened to the dashed line position shown in FIG. 3. At this time, the notches 107 and 108 in the intermediate rod portion 109 are moved outwardly to a position at the facing portion of the side rail 62 of the door 12 such that the sliding, bifurcated locking element 94 can be slid upwardly to pass around the rod portion 109 and engage the notches or flats 107 and 108 formed thereon. In this position, the sliding, bifurcated locking element 94 is retained in a latching position as the compression spring 143, while under compression, pulls the shoulders at one side of the flats 107 and 108 firmly against the opposite legs of the locking element 94 on opposed sides of the bifurcation therein. The locking element 94 will thus remain in this position, and will prevent the spring from expanding to close the door and draw the rod portion 109 into the hollow interior of the side rail 62 until such time as the locking element is slid downwardly to disengage it from the flats 107 and 108. Disengagement can be effected simply by slightly moving the door outwardly toward a wider opened position. This will further compress the spring 143, and will allow the locking element 94 to fall downwardly to the point where its downward movement is arrested by the head 100 of the stop element illustrated in FIG. 6.

The storm door assembly of the invention is quite durable and is mechanically strong by reason of its construction. The employment of the elongated L-shaped reinforcing flange 15 effectively at least doubles the strength of the Z-bar at that side of the Z-bar to which the door 12 is hinged. Thus, when the door is suddenly whipped outwardly by the wind to its fully opened position, the stress imposed upon the Z-bar is in part distributed to the reinforcing flange 15, and both Z-bar and reinforcing flange are firmly anchored by the screws 26 in the door jamb 24. As a result of this construction, the Z-bar and its associated reinforcing flange cannot easily be ripped or torn loose from the door jamb 24 despite whipping of the door 12 under high wind conditions. It may be observed that where this type of abuse of the door 12 can be anticipated due to prevailing climatic conditions, it is preferred to use one single elongated pintle for engaging the hinge elements 70 of the door with the Z-bar.

The novel screen subassembly 134 is also an important feature of the present invention. This screen subassembly is particularly sturdy and presents at the outer side of the door 12 the expanded metal grille 54 which is much stronger and more vandal-resistant than a screen panel such as the internal screen panel 158. It does not obstruct the free flow of air, however, at such time as the slidable window sash subassembly 136 may be elevated to allow ventilation during the spring, summer and fall.

From the foregoing description of the invention, it will be perceived that the present invention provides an improved storm door assembly which is characterized in having a long and trouble-free service life, is very aesthetic when installed, and which, due to its mode of construction, can be quickly and easily installed without the use of sophisticated and expensive tools or implements.

Although a preferred embodiment of the invention has been herein described in order to clearly exemplify the basic principles which underlie the invention, it will be understood that various structural changes and rearrangements can be made within the scope of the invention without departure from the underlying basic principles. For example, a single lite door containing a single pane, which may be a thermopane panel, can be utilized in the door, and the spring subassembly then located in either the top rail or a bottom rail, or spring subassemblies can then be used in both such rails. Changes and alterations of this type are therefore deemed to be circumscribed by the spirit and scope of the invention except as the same may be necessarily limited by the appended claims or reasonable equivalents thereof.

What is claimed is:

1. A storm door comprising:

a pair of opposed, parallel, hollow, elongated side rails;

a hollow header extending between and interconnecting the side rails at one of their ends;

a bottom rail extending between and interconnecting the side rails at their opposite ends;

a hollow center mullion extending between said side rails and parallel to said header and bottom rail, said center mullion including a front plate;

a bottom plate;

a top plate having a recess therein;

a resilient sealing pad mounted on said top plate and including a portion retained in said recess; and a removable inspection plate extending substantially parallel to said front plate and removably engaging said top plate and said bottom plate;

a kick plate between said center mullion and said bottom rail;

a spring return subassembly having a major portion thereof enclosed within one of said rails, header and center mullion;

a latch subassembly mounted on one of said side rails and including a part slidably and reciprocably movable on said one side rail in a direction parallel to the length of said one side rail, said part positioned for engaging said spring return subassembly in one position of the part to inactivate said spring return assembly;

a slidable window sash subassembly slidably mounted between said side rails and resting in one portion upon said resilient sealing pad; and a screen subassembly extending between said side rails at a position to overlie and extend parallel to said window sash subassembly when said window sash subassembly rests upon said resilient sealing pad, said screen subassembly including an expanded metal grille;

a screen extending parallel to said expanded metal grille; and means extending around and receiving edges of said grille and screen to retain them in their positions relative to each other.

2. A storm door as defined in claim 1 wherein said one side rail defines a channel and a tongue-receiving recess;

and wherein said storm door further includes a plurality of spaced hinge elements secured to one of said side rails; each of said hinge elements including:

a mounting section extending into said channel;

a tubular end portion; and a T-shaped tongue connected to said mounting section and slidingly received in said tongue-receiving recess.

3. A storm door as defined in claim 1 wherein said latch subassembly further includes a stop element secured to said one side rail and limiting the distance said latch subassembly part can move lengthwise of said one rail in a direction away from said spring return subassembly.

4. A storm door as claimed in claim 1 wherein said spring return subassembly comprises:

an articulated bolt having a portion extending into the hollow interior of said center mullion and a portion lying outside said center mullion; and adjustable spring means connected to said articulated bolt and positioned inside said center mullion for resiliently biasing said storm door to a closed position from an open position.

5. A storm door as claimed in claim 4 wherein said adjustable spring means comprises:

elongated spring rod means having one end connected to said articulated bolt portion, and further having a second end movably connected to said center mullion for movement relative to the storm door when it swings open in pivotation about a pivotal axis extending along said one elongated side rail;

a spring stop disc movably mounted on said spring rod means for selective movement and adjustment of position in an axial direction along said spring rod means; and a spring positioned between said spring stop disc and said one elongated side rail for undergoing compression when said storm door is pivoted about said pivotal axis.

6. A storm door assembly comprising:

a U-shaped Z-bar including two opposed parallel sides interconnected at one end by a header;

a storm door hinged to one side of said Z-bar and positioned between the two sides of the Z-bar, said storm door comprising:

a pair of opposed side rails;

a header extending between said side rails at one end thereof;

a center mullion extending between said side rails, and extending parallel to, and spaced from, said header;

a slidable window sash subassembly slidably mounted between said side rails and supported in one position on said center mullion; and a screen subassembly extending between said side rails at a position to overlie and extend parallel to said window sash subassembly when said window sash subassembly is supported on said center mullion, said screen subassembly comprising:

a lower rail defining a first open channel and a second open channel;

opposed side rails and a top rail each conforming in cross-sectional configuration to said screen subassembly lower rail and interconnected with said screen subassembly lower rail in a rectangular frame;

an expanded metal grille having edges extending into channels in said lower, side and top screen subassembly rails, and filling said rectangular frame; and a screen panel having edges extending into channels in said lower, side and top screen subassembly rails, and extending parallel to said expanded metal grille within said rectangular frame;

an elongated reinforcing flange extending parallel to said one side of said Z-bar on the opposite side thereof from said storm door;

fastening means extending through said Z-bar and said reinforcing flange and adapted for securement of the Z-bar and reinforcing flange to a door jamb; and a tubular, resilient cushioning bead secured to at least one of said headers and one of said opposed parallel sides of said Z-bar in position to contact said storm door when the storm door is in a closed position within said Z-bar.

7. A storm door assembly comprising:

a U-shaped Z-bar including two, opposed parallel sides interconnected at one end by a header, one side of said Z-bar comprising:

a facing flange;

a central web portion extending normal to said facing flange; and a curvilinear portion interconnecting said facing flange and central web portion and defining a vertically extending pintle-receiving space, said curvilinear portion having spaced slots therein;

a storm door hinged to said one side of said Z-bar and positioned between the two sides of the Z-bar, said storm door comprising:

a pair of opposed side rails;

a header extending between said side rails at one end thereof;

a center mullion extending between said side rails, and extending parallel to, and spaced from, said header;

a slidable window sash subassembly slidably mounted between said side rails and supported in one position on said center mullion; and a screen subassembly extending between said side rails at a position to overlie and extend parallel to said window sash subassembly when said window sash subassembly is supported on said center mullion;

a plurality of hinges pivotally interconnecting said storm door and said Z-bar, each of said hinges including:

a tubular end portion projecting into one of said slots and registering with said curvilinear portion; and a portion engaging said storm door;

a tubular resilient cushioning bead secured to at least one of said headers and one of said opposed parallel sides of said Z-bar in position to contact said storm door when the storm door is in a closed position within said Z-bar;

an elongated reinforcing flange extending parallel to said one side of said Z-bar on the opposite side thereof from said storm door;

fastening means extending through said Z-bar and said reinforcing flange and adapted for securement of the Z-bar and reinforcing flange to a door jamb; and a spring return assembly comprising:

bolt means extending through said Z-bar and reinforcing flange;

an elongated spring rod connected at one of its ends to said bolt means;

a spring stop disc threaded on said spring rod for axial movement therealong upon rotation of the stop disc;

a spring mounted between said stop disc and the center mullion for undergoing resilient deformation as said stop disc is moved axially on said spring rod; and means connecting the second end of said spring rod to the center mullion to permit said second end and said stop disc to undergo movement relative to said center mullion and said spring when the center mullion is opened.

8. A storm door assembly comprising:

a U-shaped Z-bar including two opposed parallel sides interconnected at one end by a header;

a storm door hinged to one side of said Z-bar and positioned between the two sides of the Z-bar, said storm door comprising:

a pair of opposed side rails;

a header extending between said side rails at one end thereof;

a hollow center mullion extending between said side rails and extending parallel to, and spaced from, said header;

a slidable window sash subassembly slidably mounted between said side rails and supported in one position on said center mullion; and a screen subassembly extending between said side rails at a position to overlie and extend parallel to said window sash subassembly when said window sash subassembly is supported on said center mullion;

a spring return assembly interconnecting said storm door and Z-bar to return said storm door to a closed position within said Z-bar, said spring return assembly comprising:

bolt means extending through said Z-bar; and spring means connected to said bolt means, said spring means comprising:

an elongated spring rod connected at one of its ends to said bolt means and positioned within said center mullion;

a spring stop disc threaded on said spring rod for axial movement therealong upon rotation of the stop disc;

a spring mounted between said stop disc and the center mullion for undergoing resilient deformation as said stop disc is threaded axially on said spring rod; and means connecting the second end of said spring rod to the center mullion to permit said second end and said stop disc to undergo movement relative to said center mullion and said spring when the center mullion is opened.

9. A storm door assembly comprising:

a U-shaped Z-bar including two opposed, parallel sides interconnected at one end by a header, said Z-bar comprising:

a facing flange;

a central web portion extending normal to said facing flange; and a curvilinear portion interconnecting said facing flange and central web portion and defining a vertically extending pintel-receiving space, said curvilinear portion having spaced slots therein;

a storm door hinged to one side of said Z-bar and positioned between the two sides of the Z-bar, said storm door including a pair of parallel side rails, one of said side rails defining a T-shaped recess;

a plurality of hinges corresponding in number to the number of slots in said curvilinear portion, each of said hinges including:

a tubular end portion projecting into one of said slots and extending completely and without interruption from one of the ends of said one slot to the other and registering with said curvilinear portion, with the hollow interior of the tubular end portion in alignment with the vertically extending pintle-receiving space defined by said curvilinear portion;

a T-shaped tongue slidably registering with said T-shaped recess; and a portion carrying said T-shaped tongue and engaged with said storm door;

at least one elongated pintle pin interconnecting said hinges with said Z-bar by extension through said tubular end portions and the pintle-receiving space of said curvilinear portion; and fastening means extending through said Z-bar and adapted for securement of the Z-bar to a door jamb.

10. A storm door assembly comprising:

a U-shaped Z-bar including two opposed parallel sides interconnected at one end by a header;

a storm door hinged to one side of said Z-bar and positioned between the two sides of the Z-bar, said storm door comprising:

a pair of opposed side rails;

a header extending between said side rails at one end thereof; and a hollow center mullion extending between said side rails, and extending parallel to, and spaced from, said header, said center mullion including an inspection plate removable from the remainder of said center mullion to expose the hollow interior thereof;

hinge means pivotally supporting said storm door to one side of said Z-bar; and a spring return subassembly including:

an articulated bolt having a portion extending through said one opposed parallel side of said Z-bar and further projecting into the hollow interior of said center mullion when the storm door is closed, and moving to a position in which a greater portion of said articulated bolt is outside said center mullion when the storm door is opened;

elongated spring rod means having one end connected to said articulated bolt portion, and having threads around a portion of said spring rod means spaced from said one end and further having a second end movably connected to said door through said center mullion whereby said second end can move with respect to said center mullion as said door opens and closes;

a spring stop disc threaded on said spring rod means; and a spring between said spring stop disc and said center mullion;

said spring stop disc and spring being accessible from outside said storm door when said inspection plate is removed from said center mullion to facilitate adjustment of the degree to which said spring will be compressed when said door is opened.

11. A storm door assembly comprising:

a U-shaped Z-bar including two opposed parallel sides interconnected at one end by a header;

a storm door hinged to one side of said Z-bar and positioned between the two sides of the Z-bar, said storm door comprising:

a pair of opposed side rails;

a header extending between said side rails at one end thereof;

a center mullion extending between said side rails, and extending parallel to, and spaced from, said header;

a slidable window sash subassembly slidably mounted between said side rails and supported in one position on said center mullion; and a screen subassembly extending between said side rails at a position to overlie and extend parallel to said window sash subassembly when said window sash subassembly is supported on said center mullion, said screen subassembly comprising:

a lower rail defining a first open channel and a second open channel;

opposed side rails and a top rail each conforming in cross-sectional configuration to said screen subassembly lower rail and interconnected with said screen subassembly lower rail in a rectangular frame;

an expanded metal grille having edges extending into channels in said lower, side and top screen subassembly rails, and filling said rectangular frame; and a screen panel having edges extending into channels in said lower, side and top screen subassembly rails, and extending parallel to said expanded metal grille within said rectangular frame.

12. A storm door assembly comprising:

a U-shaped Z-bar including two, opposed parallel sides interconnected at one end by a header, one side of said Z-bar comprising:

a facing flange;

a central web portion extending normal to said facing flange; and a curvilinear portion interconnecting said facing flange and central web portion and defining a vertically extending pintle-receiving space, said curvilinear portion having spaced slots therein;

a storm door hinged to said one side of said Z-bar and positioned between the two sides of the Z-bar, said storm door comprising:

a pair of opposed side rails;

a header extending between said side rails at one end thereof;

a center mullion extending between said side rails, and extending parallel to, and spaced from, said header;

a slidable window sash subassembly slidably mounted between said side rails and supported in one position on said center mullion; and a screen subassembly extending between said side rails at a position to overlie and extend parallel to said window sash subassembly when said window sash subassembly is supported on said center mullion;

a plurality of hinges pivotally interconnecting said storm door and said Z-bar, each of said hinges including:

a tubular end portion projecting into one of said slots and registering with said curvilinear portion; and a portion engaging said storm door;

a spring return assembly comprising:

bolt means extending through said Z-bar;

an elongated spring rod connected at one of its ends to said bolt means;

a spring stop disc threaded on said spring rod for axial movement therealong upon rotation of the stop disc;

a spring mounted between said stop disc and the center mullion for undergoing resilient deformation as said stop disc is moved axially on said spring rod; and means connecting the second end of said spring rod to the center mullion to permit said second end and said stop disc to undergo movement relative to said center mullion and said spring when the center mullion is opened.

* * * * *